US006427928B1

(12) United States Patent
Hirota et al.

(10) Patent No.: US 6,427,928 B1
(45) Date of Patent: Aug. 6, 2002

(54) STRAW WITH PLUG

(75) Inventors: Kashichi Hirota, Hachioji; Makoto Kaneda, Hiki-Gun, both of (JP)

(73) Assignee: Kyowa Electric and Chemical Co., Ltd., Tokyo (JP)

( * ) Notice: Subject to any disclaimer, the term of this patent is extended or adjusted under 35 U.S.C. 154(b) by 0 days.

(21) Appl. No.: 09/656,424

(22) Filed: Sep. 6, 2000

(30) Foreign Application Priority Data

Mar. 14, 2000 (JP) ..... 12-070077

(51) Int. Cl.[7] ..... A47G 21/18

(52) U.S. Cl. ..... 239/33; 239/24; 239/289; 220/705; 215/229; 215/388

(58) Field of Search ..... 239/24, 33, 289; 220/705–710; 215/229, 388, 389; 229/103.1; 138/121; 426/85

(56) References Cited

U.S. PATENT DOCUMENTS 2,066,121 A * 12/1936 Morris ..... 239/33 X
3,220,587 A * 11/1965 Griffin et al. ..... 215/388
3,291,331 A * 12/1966 Grisham et al. ..... 215/388
4,448,316 A * 5/1984 Hiroshige ..... 239/33 X
5,160,058 A * 11/1992 Ahn ..... 220/710 X
5,513,762 A * 5/1996 Janani ..... 215/229
5,819,972 A * 10/1998 Puente Pubill ..... 220/705 X
5,823,422 A * 10/1998 Collier et al. ..... 229/103.1
6,076,729 A * 6/2000 Cornell et al. ..... 229/103.1
6,116,446 A * 9/2000 Haughton et al. ..... 215/388 X

* cited by examiner

*Primary Examiner*—Steven J. Ganey
(74) *Attorney, Agent, or Firm*—Jacobson Holman, PLLC

(57) ABSTRACT

A straw comprises a cylindrical plug member having an opening at a top thereof, and a straw member which vertically extends through a bottom portion of the plug member and which is retractable in the longitudinal direction of the straw member, wherein the straw is adapted to fit the plug member with a top of a mouth of a beverage container so as to retain in a state where the straw is inserted into the beverage container. The straw is also adapted to allow a top of the straw member to be protruded from the mouth of the beverage container by extending the straw member and to allow the top of the straw member to be contained within the plug member by retracting the straw member so as to attach a cap of the beverage container.

4 Claims, 14 Drawing Sheets

STRAW WITH PLUG

TECHNICAL FIELD

The present invention relates to a straw, more particularly to a straw capable of being contained and stored within a capped beverage container.

BACKGROUND ART

In a beverage container or dispenser capable being capped, when the beverage container is to be capped without finishing whole quantity of beverage and leaving a certain amount of beverage therein, a straw which has been in use thus far is usually taken out of the beverage container. This is done because the beverage container cannot be capped due to the interference with the straw, and even if the beverage container could successfully be capped, the straw could fall down in the container and could be sunk in the remaining beverage so that it would become unable for the straw to be taken out of the beverage container or the straw could be wetted by the beverage throughout its length so that user's hands would be made smeary when the straw would be taken out therefrom. The straw which has been taken out of the beverage container will generally be thrown aside and will never be reused. This is because, since the straw which has once been used and taken out of the beverage container is inevitably wetted with the beverage, storing as it is causes an insanitation condition and a surrounding contamination. It is troublesome to rinse and store the used straws separately from the beverage containers each time the straws are taken out of the beverage container.

DISCLOSURE OF INVENTION

In view of the foregoing disadvantages inherent in conventional beverage containers, it is an object of the present invention to provide a straw capable of being contained and stored within a capped beverage container, sanitarily and readily, without any disadvantages, such as the inability of taking out the straw from the beverage container or the possibilities of causing surrounding contamination.

According to one aspect of the present invention, there is provided a straw comprising a cylindrical plug member having a top portion formed with an opening, and a straw member vertically extending through a bottom portion of the plug member and having a longitudinal by collapsible or retractable portion, wherein the straw is held in a state inserted into the beverage container by fitting the plug member to a top of a mouth of a beverage container, the straw being able to be protruded from the mouth of the beverage container by extending the straw member and contained within the plug member by retracting the straw member so as to allow a cap of the beverage container to be attached to the container mouth.

According to another aspect of the present invention, there is provided a straw comprising a straw member including an accordion type flexible portion which makes the straw member retractable in the longitudinal direction of the straw member, and a cylindrical plug member having an opening at a top thereof, the straw member being disposed vertically extending through a bottom portion of the plug member with the accordion type flexible portion positioned within the plug member, wherein the straw is held in a state inserted into the beverage container by fitting the plug member to a top of a mouth of a beverage container, the straw being able to be protruded from the mouth of the beverage container by extending the accordion type flexible portion of the straw member and to allow the top of the straw member to be contained within the plug member by retracting the accordion type flexible portion of the straw member so as to allow a cap of the beverage container to be attached to the container mouth.

According to still an other aspect of the present invention, there is provided a straw comprising a straw member including an outer straw portion and an inner straw portion which are telescopingly interfitted with each other, and a cylindrical plug member having an opening at a top thereof, the outer straw portion of the straw member being integrally formed with or secured to the plug member, the inner straw portion of the straw member extending vertically through a bottom portion of the plug member, wherein the straw is held in a state inserted into a beverage container by fitting the plug member to a top of a mouth of a beverage container, the straw being able to be protruded from the mouth of the beverage container by extending the inner straw portion of the straw member upward and to allow a top of the straw member to be contained within the plug member by retracting the inner straw portion of the straw member so as to allow a cap of the beverage container to be attached to the container mouth. In one embodiment, the straw may include a cap portion which is mounted on the top of the plug member so that it can be fitted to the top of the plug member to close the opening of the plug top, the cap portion having. a concave inner configuration to allow the cap portion to be closed with a top of the inner straw portion of the straw member protruded from the top of the plug member.

According to yet other aspect of the present invention, there is provided a straw comprising a plug member including a cylindrical plug portion having a top portion formed with an opening therein and a cap portion adapted to removably cover the opening at the top of the plug portion, and a straw member which vertically extends through a bottom portion of the plug member, wherein the straw is held in a state inserted into the beverage container by fitting the plug member to a top of a mouth of a beverage container, the cap portion of the plug member having a concave inner configuration so that it allows the cap portion to be closed in a state where a top of the straw member is protruded from the top of the mouth of the beverage container and from the top of the plug portion of the plug member. In one embodiment, the straw member may be retractable in the longitudinal direction of the straw member.

According to one embodiment of the present invention, the plug member includes an air vent in a sidewall or bottom portion thereof.

According to yet other aspect of the present invention, there is provided a beverage container to which either of the aforementioned straws is mounted.

According to yet other aspect of the present invention, there is provided a beverage container with a straw, said a beverage container comprising a bottom wall, a sidewall and a mouth, said straw including a cylindrical plug member having a top portion formed with an opening and interfitted and mounted to the mouth of the beverage container, and a straw member having a top and a lower end and vertically extending through a bottom portion of the plug member, the lower end of the straw member being in the vicinity of the bottom wall of the beverage container, the straw member being retractable in the longitudinal direction, wherein the top of the straw member is allowed to be protruded from the mouth of the beverage container by extending the straw member and to allow the top of the straw member to be contained within the plug member by retracting the straw member to thereby allow a cap of the beverage container to be attached to the mouth.

According to yet other aspect of the present invention, there is provided a beverage container with a straw, said beverage container comprising a bottom wall, a sidewall and a mouth said straw comprising a plug member including a cylindrical plug portion and a cap portion, said plug portion having a top portion formed with an opening and fitted to the mouth of the beverage container, said cap portion being adapted to removably cover the opening at the top of the plug portion, and a straw member having a top and a lower end and vertically extending through a bottom portion of the plug member, the lower end of the straw member being in the vicinity of the bottom wall of the beverage container, the cap portion of the cap member being allowed to be closed in a state where a top of the straw member is protruded from the mouth of the beverage container and from the top of the plug portion of the plug member.

DESCRIPTION OF THE PREFERED EMBODIMENT

Preferred embodiments of the present invention will now be described with reference to the drawings.

Figure 1:
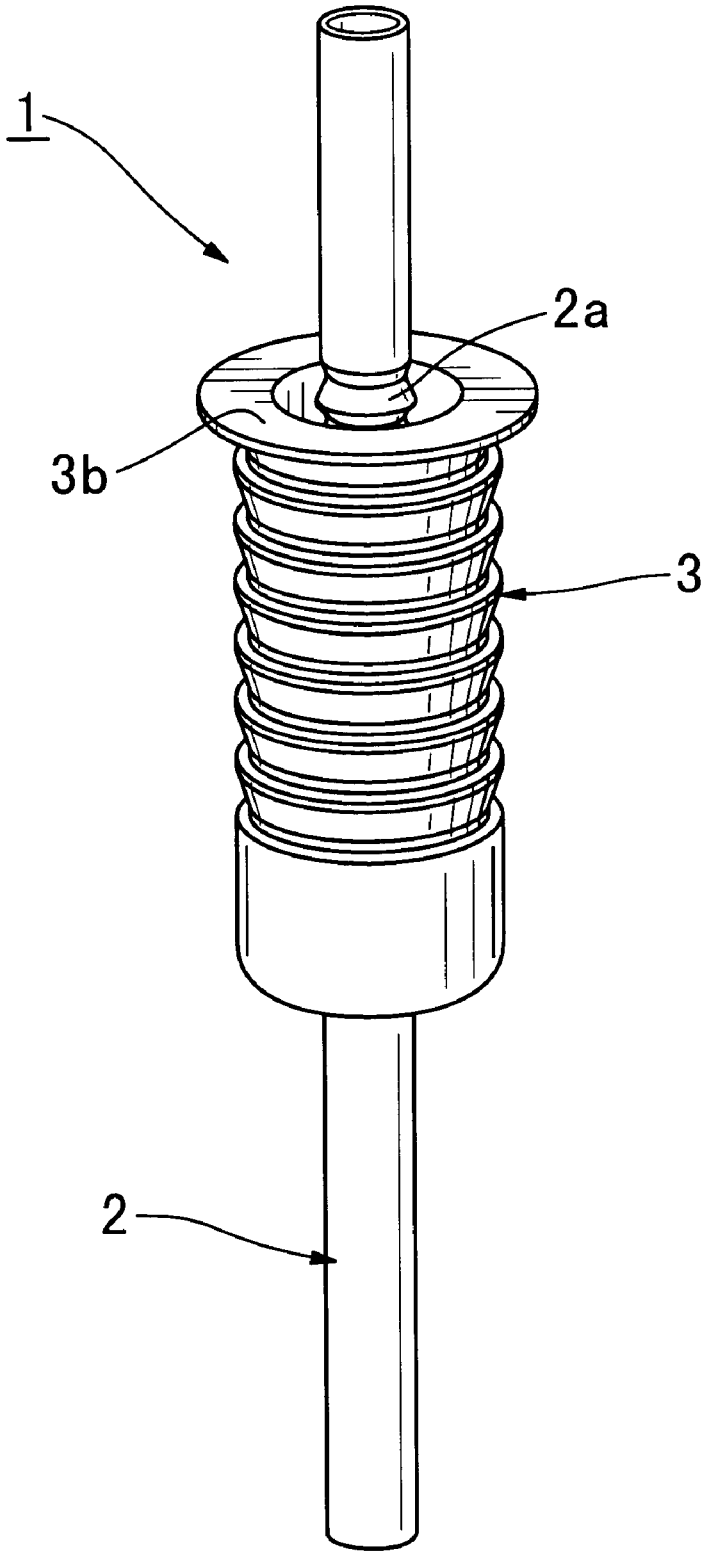
FIG. 1 is a perspective view showing a first embodiment of a straw according to the present invention.

A first embodiment of a straw according to the present invention will be firstly described. FIG. 1 is a perspective view showing the first embodiment of the straw according to the present invention, and FIG. 2 is an enlarged cross-sectional view showing an upper section of the straw shown in FIG. 1.

Figure 2:
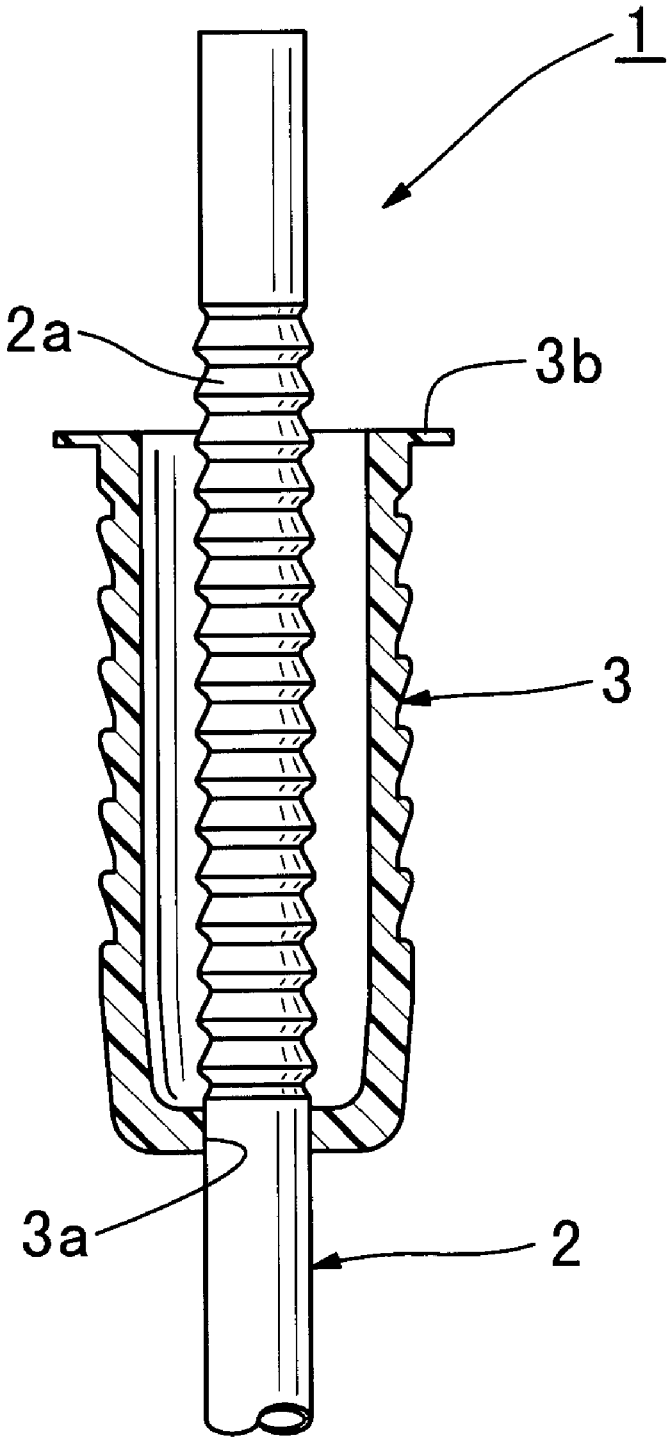
FIG. 2 is an enlarged cross-sectional view showing an upper section of the straw shown in FIG. 1.

As sown in FIGS. 1 and 2, the straw 1 of the present embodiment is formed of polypropylene and comprises a straw member 2 having an accordion, or bellows type flexible portion 2*a*, which is retractable or extensible in the longitudinal direction of the straw member, at an upper section of the straw member 2, and a cylindrical plug member 3 having an opening at a top.

A top rim 3*b* is formed on the top of the plug member 3. The top rim 3*b* surrounds a periphery of the top of the plug member 3 and protrudes outward therefrom. An aperture 3*a* is also provided at the center of a bottom portion of the plug member 3, and the straw member 2 vertically extends through the aperture 3*a*. The accordion flexible portion 2*a* is located within the plug member 3 on the upper side of the aperture 3*a*. An outside diameter of the straw member 2 is substantially equal to a diameter of the aperture 3*a* so that no clearance exists between a periphery of the straw member 2 and the aperture 3*a*. An outside diameter of the accordion flexible portion 2*a* of the straw member 2 is lager than the diameter of the aperture 3*a* so that the accordion flexible portion 2*a* may not get through the aperture 3*a*.

Figure 3:
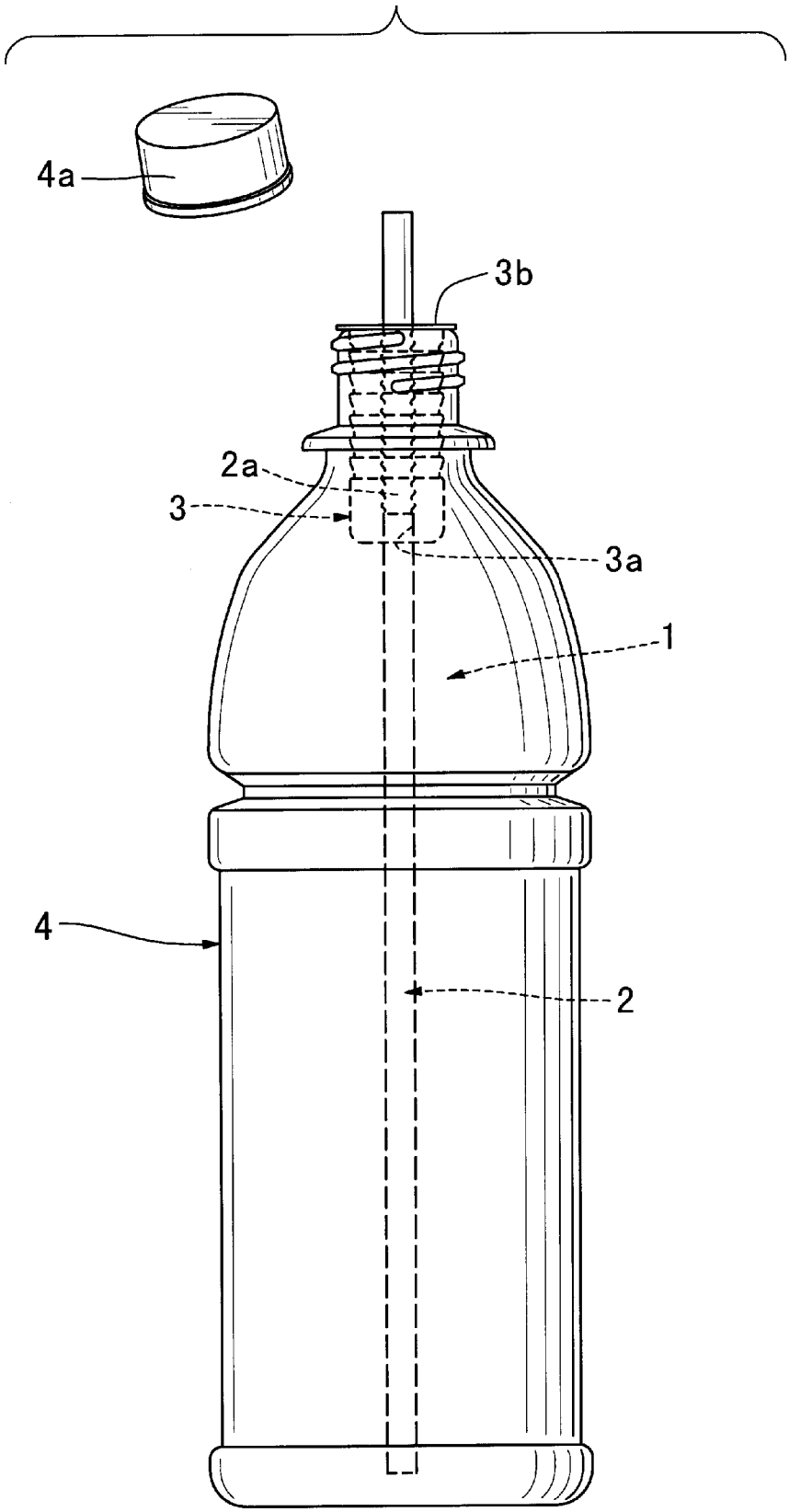
FIG. 3 is a front view showing a state where the straw shown in FIG. 1 is inserted into a beverage container and used.
Figure 4:
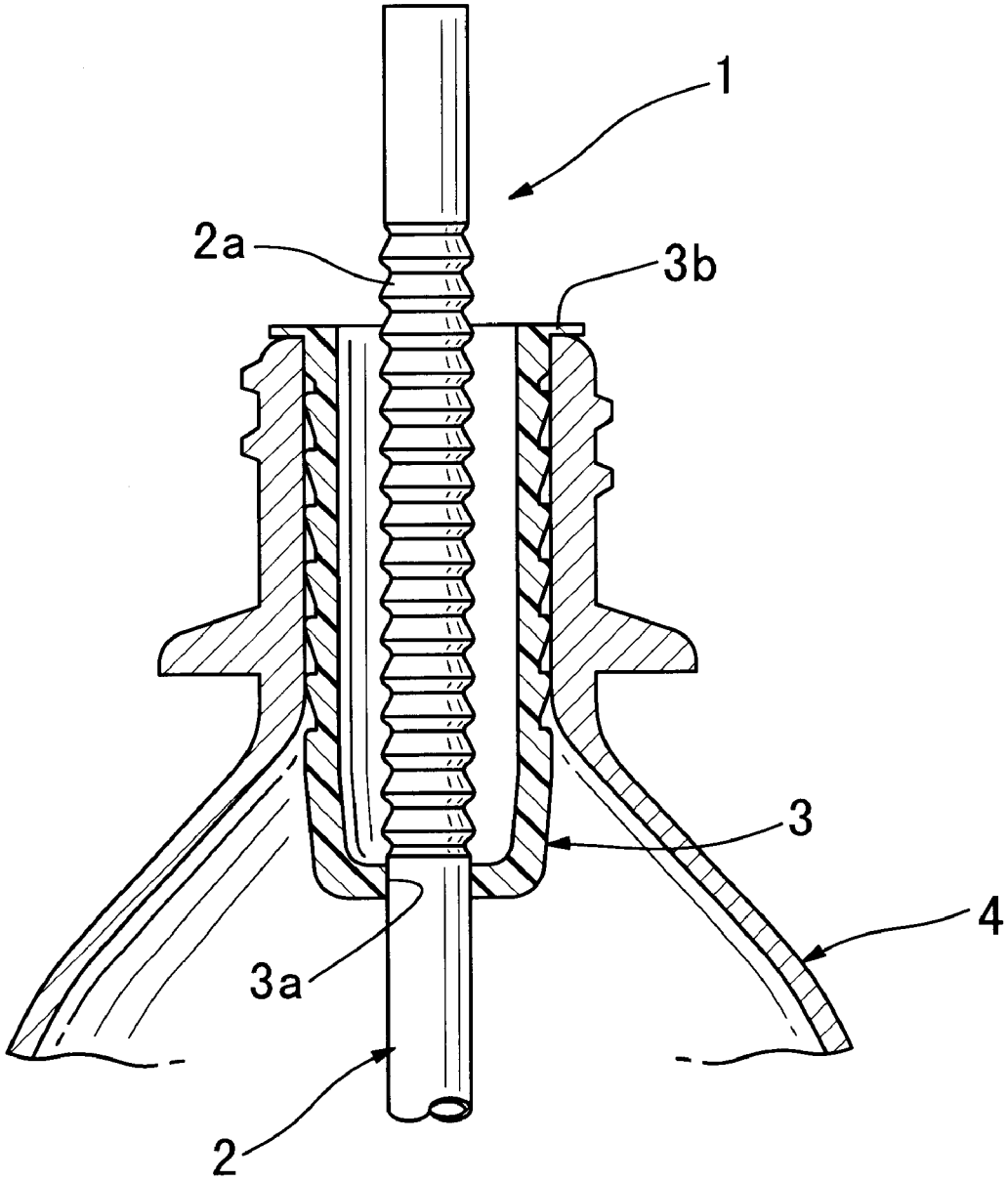
FIG. 4 is an enlarged cross-sectional view showing an upper section of the straw and beverage container shown in FIG. 3.
Figure 5:
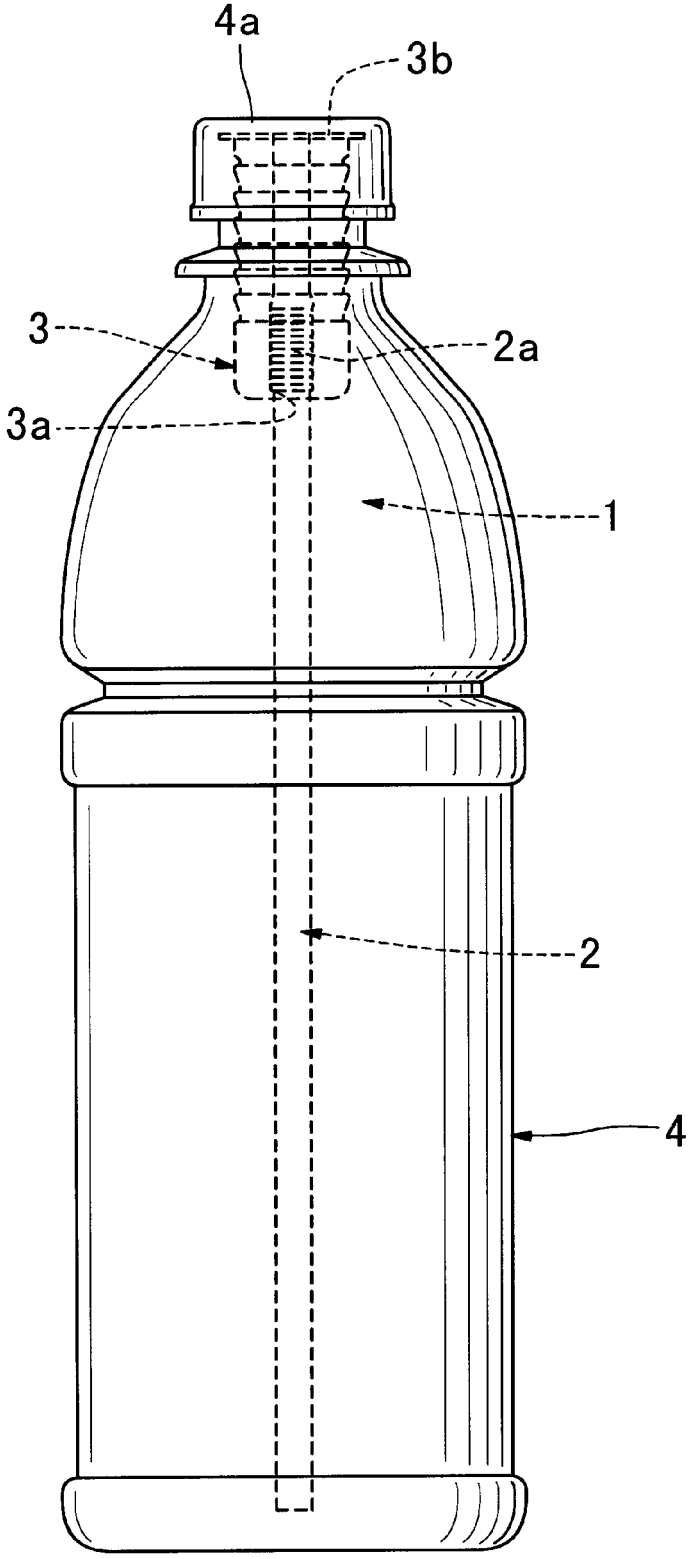
FIG. 5 is a front view showing a state where the straw shown in FIG. 1 is stored within the beverage container.
Figure 6:
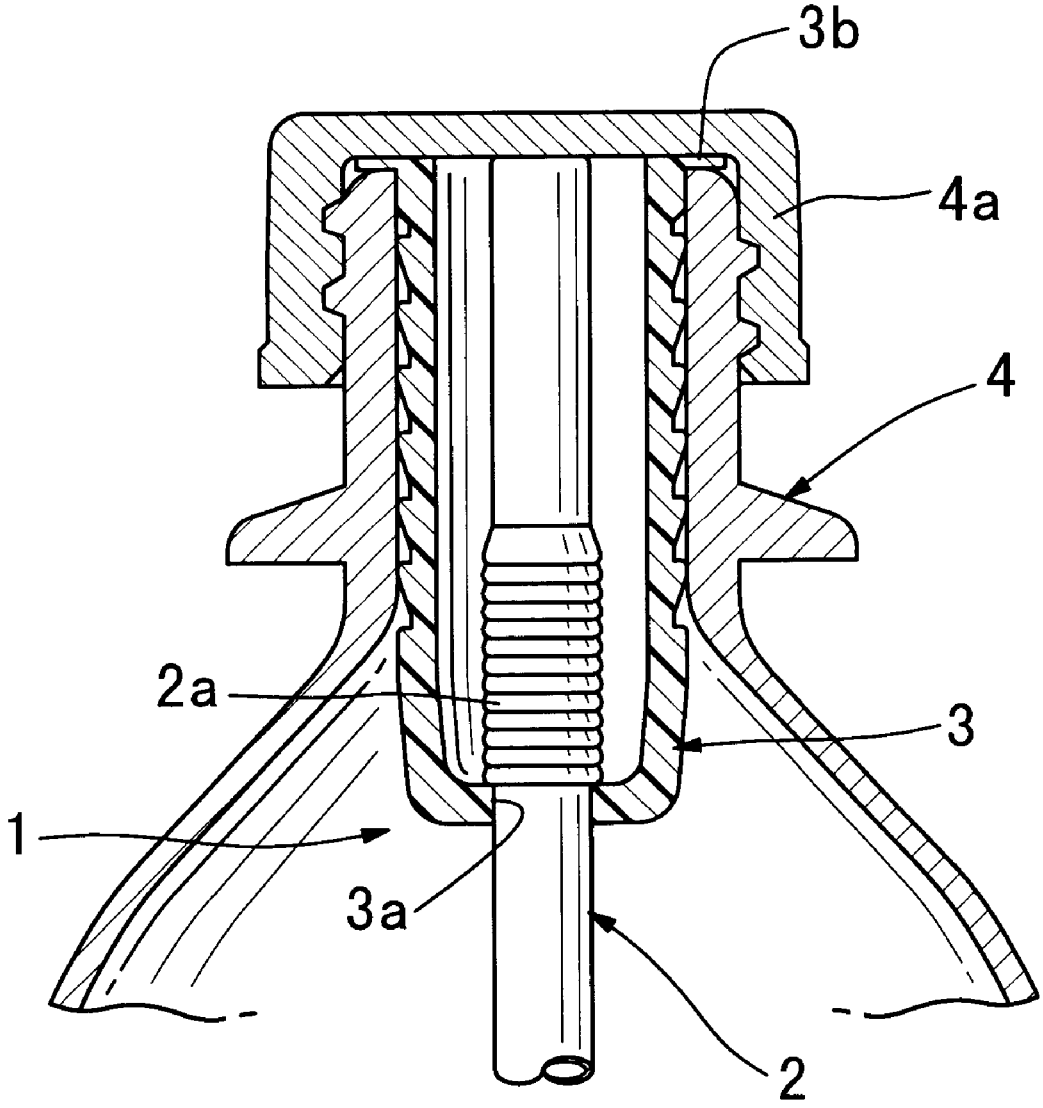
FIG. 6 is an enlarged cross-sectional view showing an upper section of the straw and beverage container shown in FIG. 5.

FIG. 3 is a front view showing the straw shown in FIG. 1 in use, and FIG. 4 is an enlarged cross-sectional view showing an upper section of the straw and beverage container shown in FIG. 3. FIG. 5 is a front view showing a state where the straw shown in FIG. 1 is stored within the beverage container, and FIG. 6 is an enlarged cross-sectional view showing an upper section of the straw and beverage container shown in FIG. 5.

As shown in FIGS. 3 to 6, the outside diameter of the plug member 3 is substantially equal to the inside diameter of a mouth of a beverage container or beverage dispenser 4. Thus, the straw 1 is retained in the inserted state to a beverage container 4 by supporting the top rim 3*b* of the plug member with a top of the mouth of the beverage container 4. In this state, the lower end of the straw member 2 is in the vicinity of the bottom wall of the beverage container 4.

When a beverage in the beverage container 4 is to be drunk, the accordion flexible portion is extended as shown in FIGS. 3 and 4 so that the beverage may be drunk through the top of the straw member 2 which is protruded from the mouth of the beverage container 4. Since the straw member extends from the position protruded from the mouth of the beverage container 4 to the portion close to the bottom wall of the beverage container 4, a user may be able to exhaustively drink the beverage in the beverage container 4 through the protruded top of the straw member 2.

For storing the straw 1, the beverage container 4 is provided with a cap 4*a* which is adapted to be attached to the mouth of the container after straw member 2 is retracted at the accordion flexible portion 2*a* so as to accommodate the top of the straw member 2 within the plug member 3. The top rim 3*b* has an outside diameter which is smaller than the inside diameter of the cap 4*a* of the beverage container 4, and a thickness which is equal to a gap created between the top of the mouth of the beverage container 4 and a top plate of the cap 4*a* when the cap 4*a* is attached to the beverage container 4. Thus, since the top rim 3*b* emplaced on the top of the mouth of the beverage container 4 is readily accommodated by the aforementioned gap when the cap 4*a* of the beverage container 4 is attached, the top rim 3*b* does not interfere with the cap 4*a* attached to the beverage container 4.

Thus, when the straw 1 is stored within the beverage container 4, by virtue of the plug member 3, the straw member 2 is retained so as not to tile and submerge in the beverage, and the upper section of the straw member 2 is protected so as not to be wetted with the beverage.

Figure 7:
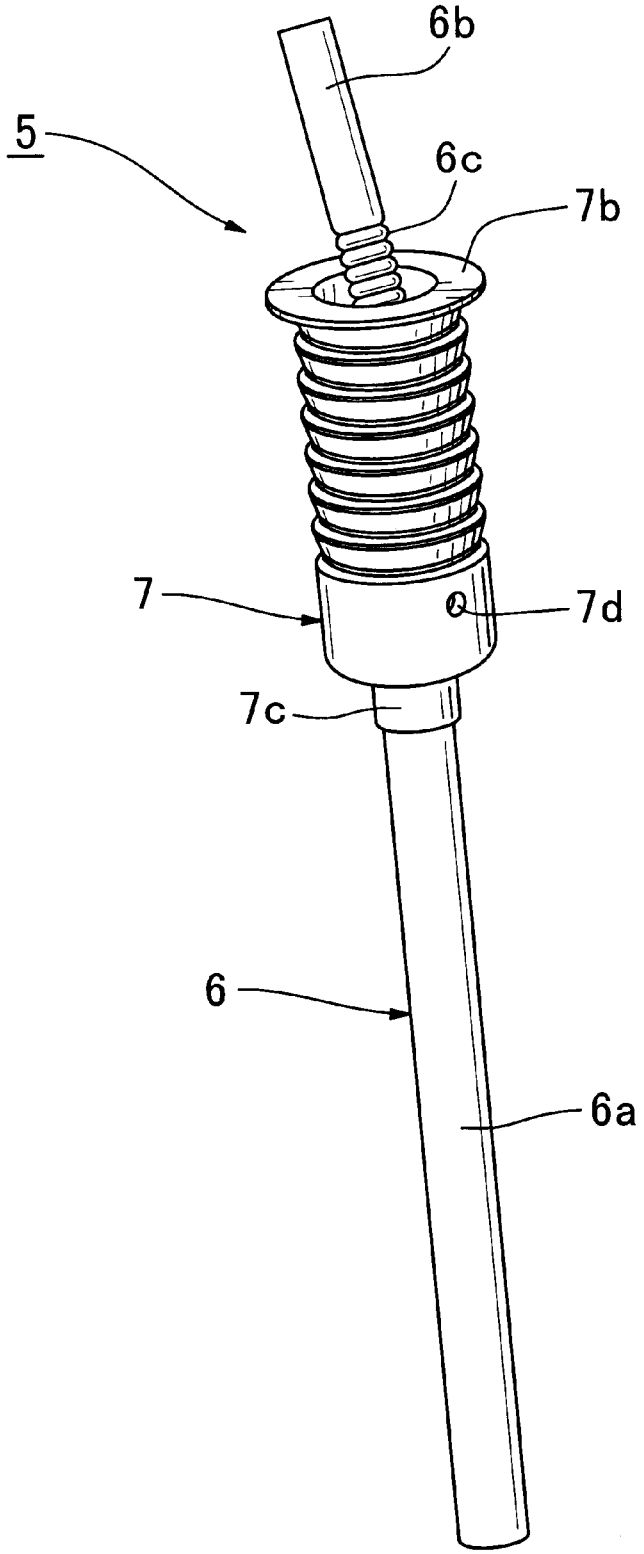
FIG. 7 is a perspective view showing a second embodiment of a straw according to the present invention.

A second embodiment of a straw according to the present invention will be described. FIG. 7 is a perspective view showing the second embodiment of the straw according to the present invention, and FIG. 8 is a cross-sectional view showing the straw shown in FIG. 7.

Figure 8:
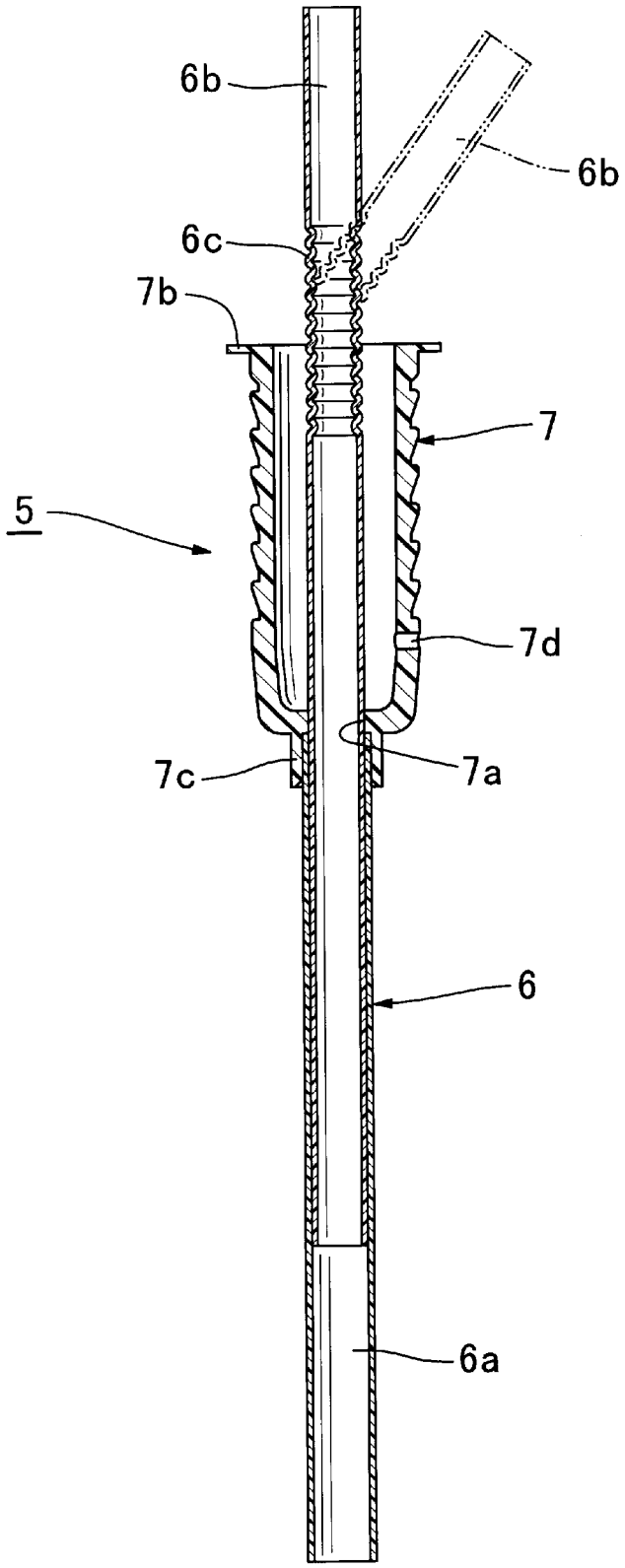
FIG. 8 is a cross-sectional view showing the straw shown in FIG. 7.

As shown in FIGS. 7 and 8, the straw 5 of the present embodiment is formed of polypropylene, and comprises a straw member 6 and a cylindrical plug member 7 which has an opening at the top thereof. The straw member 6 includes an outer straw portion 6*a* and an inner straw portion 6*b* which has a bendable bending portion 6*c* at an upper section thereof.

A top rim 7*b* is formed on the top of the plug member 7. The top rim 7*b* surrounds a periphery of the top of the plug member 7 and protrudes outward therefrom. An air vent 7*b* is provided in a lower section of a sidewall of the plug member 7. At the center of a bottom portion of the plug member 7, there is provided an aperture 7*a* and an inserting mouth 7*c* which surrounds a periphery of the aperture 7*a* and protrudes downward. A top of the outer straw portion 6*a* is inserted into and fitted with the inserting mouth 7*c*. Since an outside diameter on the outer straw portion 6*a* is substantially equal to an inside diameter of the inserting mouth 7*c*, the outer straw portion 6*a* is secured to the plug member 7 at the top thereof. A part of the inner straw portion 6*b* extends vertically through the aperture 7*a*, and a part of the inner straw portion is inserted into the outer straw portion. Since an inside diameter of the outer straw portion 6*a* is substantially equal to an outside diameter of the inner straw portion 6*b*, the inner straw portion 6*b* slidably touches internally to the outer straw portion 6*a* so that the outer straw portion 6*a* and the inner straw portion 6*b* may function as an integrated straw capable of telescopingly extending and retracting. Since the outside diameter of the inner straw portion 6*b* is substantially equal to a diameter of the aperture 7*a*, no clearance exists between a periphery of the inner straw portion 6*b* and the aperture 7*a*.

Figure 9:
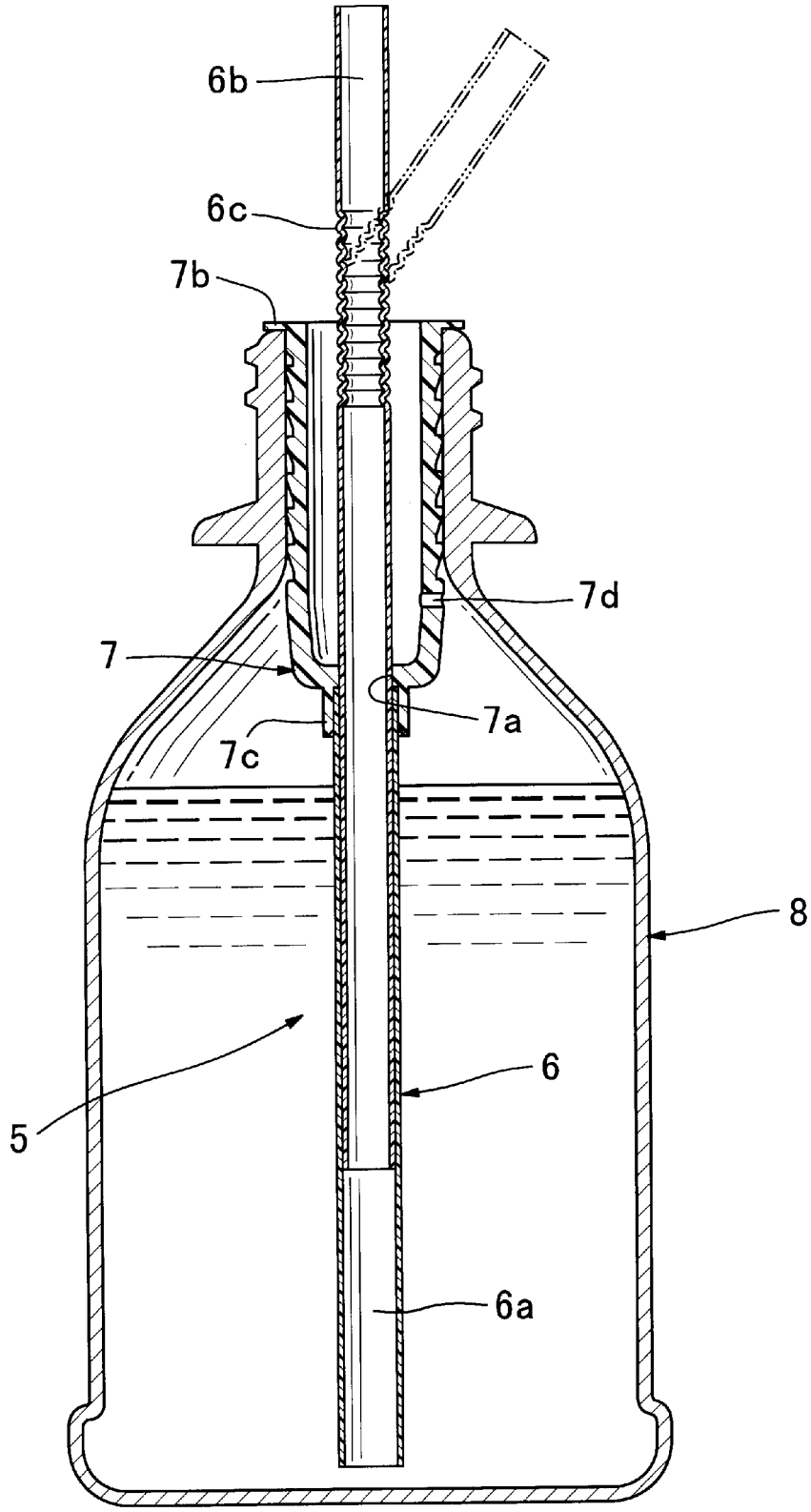
FIG. 9 is a cross-sectional view showing a state where the straw shown in FIG. 7 is inserted into a beverage container and used.
Figure 10:
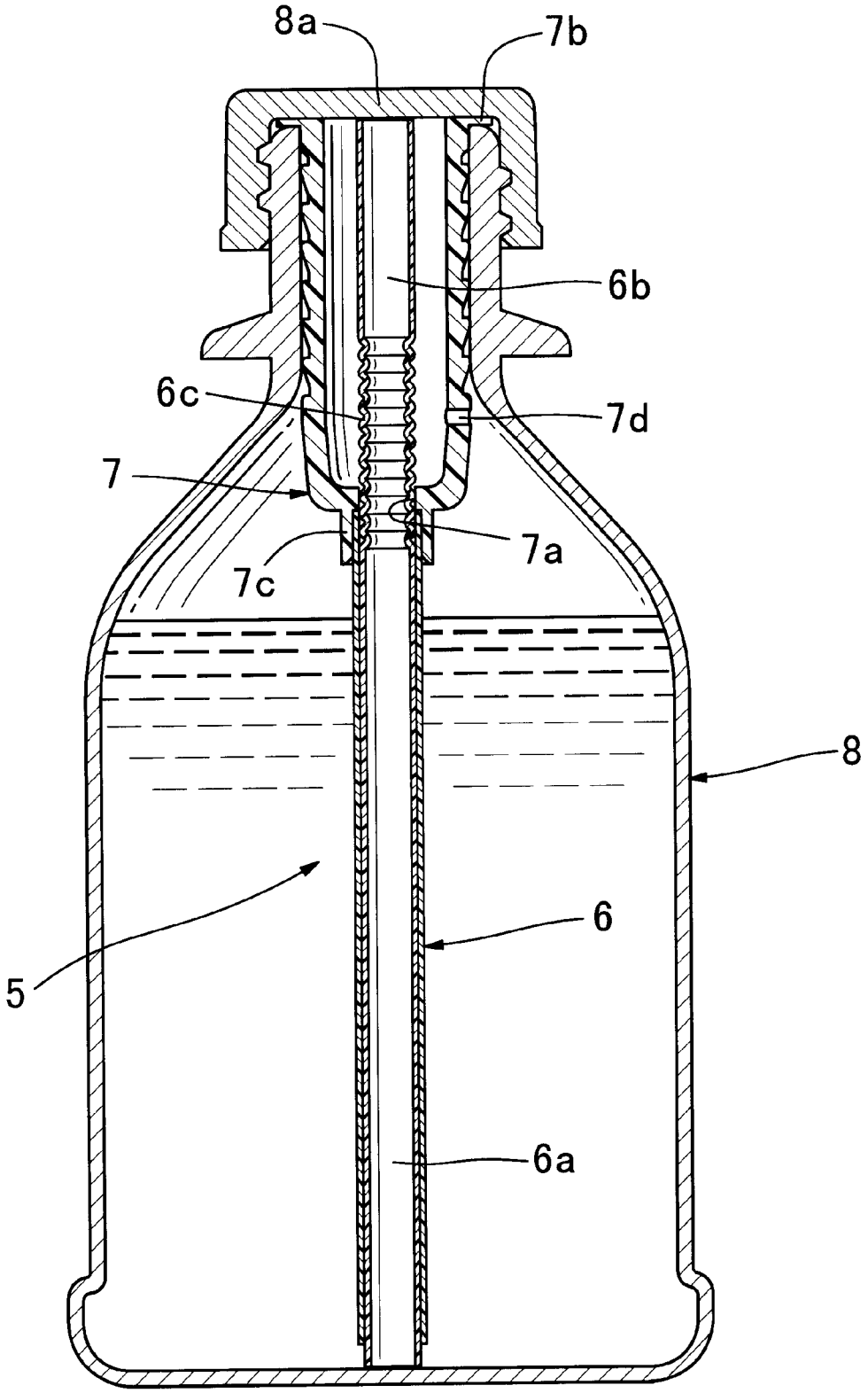
FIG. 10 is a cross-sectional view showing a state where the straw shown in FIG. 7 is stored within the beverage container.

FIG. 9 is a cross-sectional view showing a state where the straw shown in FIG. 7 is used, and FIG. 10 is a cross-sectional view showing a state where the straw shown in FIG. 7 is stored within the beverage container.

As shown in FIGS. 9 and 10, an outside diameter of the plug member 7 is substantially equal to an inside diameter of a mouth of a beverage container 8. Thus, the straw 5 is retained in the inserted state to a beverage container 8 by supporting the top rim 7*b* with a top of the mouth of the beverage container 8. In this state, a lower end of the outer straw portion 6*a* reaches the vicinity of a bottom wall of the beverage container 8.

When a beverage in the beverage container 8 is to be drunk with the straw 5, the inner straw portion 6*a* is extended or pulled out from the plug member 7 as shown in FIG. 9 so that the beverage may be drunk through the top of the inner straw portion 6*a* which protrudes from the mouth of the beverage container 8. Since the straw member 6 gets into the extended state extending from the position protruded from the mouth of the beverage container 8 to the vicinity of a bottom wall of the beverage container 8, a user may exhaustively drink the beverage in the beverage container 8 through the protruded top of the straw member 6.

When the straw 5 is to be stored, the inner straw portion 6*b* is retracted or pushed into the plug member 7 so as to accommodate the top of the inner straw portion 6*b* within the plug member 7, and a cap 8*a* of the beverage container 8 is then attached to store the straw 5. An outside diameter of the top rim 7*b* is smaller than an inside diameter of the cap 8*a* of the beverage container 4, and a thickness of the top rim 7*b* is equal to a gap created between the top of the mouth of the beverage container 8 and a top plate of the cap 8*a* when the cap 8*a* is attached to the beverage container 8. Thus since the top rim 7*b* emplaced on the top of the mouth of the beverage container 8 is promptly accommodated by the aforementioned gap when the cap 8*a* of the beverage container 8is attached, the top rim 3*b* never disturb to attach the cap 8*a* to the beverage container 8.

Thus, when the straw 5 is stored within the beverage container 8, by virtue of the plug member 7, the straw member 6 is retained so as not to tile and submerge in the beverage, and the upper section of the straw member 6 is protected so as not to be wetted with the beverage. In addition, the air vent 7*d* is provided in the sidewall of the plug member 7. This may prevent the straw 5 from dropping off from the beverage container 8 due to increased inner pressure of the beverage container 8.

While the outer straw portion 6*a* and the plug member 7 are separate components in the present embodiment, they may be integrally formed.

Further, while the present embodiment is configured to allow the outer straw portion 6*a* and the inner straw portion 6*b* to slidably touch internally each other, the present invention is not limited to this structure. For example, in the present embodiment, the inside diameter of the outer straw portion 6*a* is set in larger size than the outside diameter of the inner straw portion 6*b* so that the outer straw portion 6*a*, inner straw portion 6*b* and a bottom portion of the plug member adjacent to the aperture 7*a* may function as an integrated straw capable of telescopingly extending and retracting.

Figure 11:
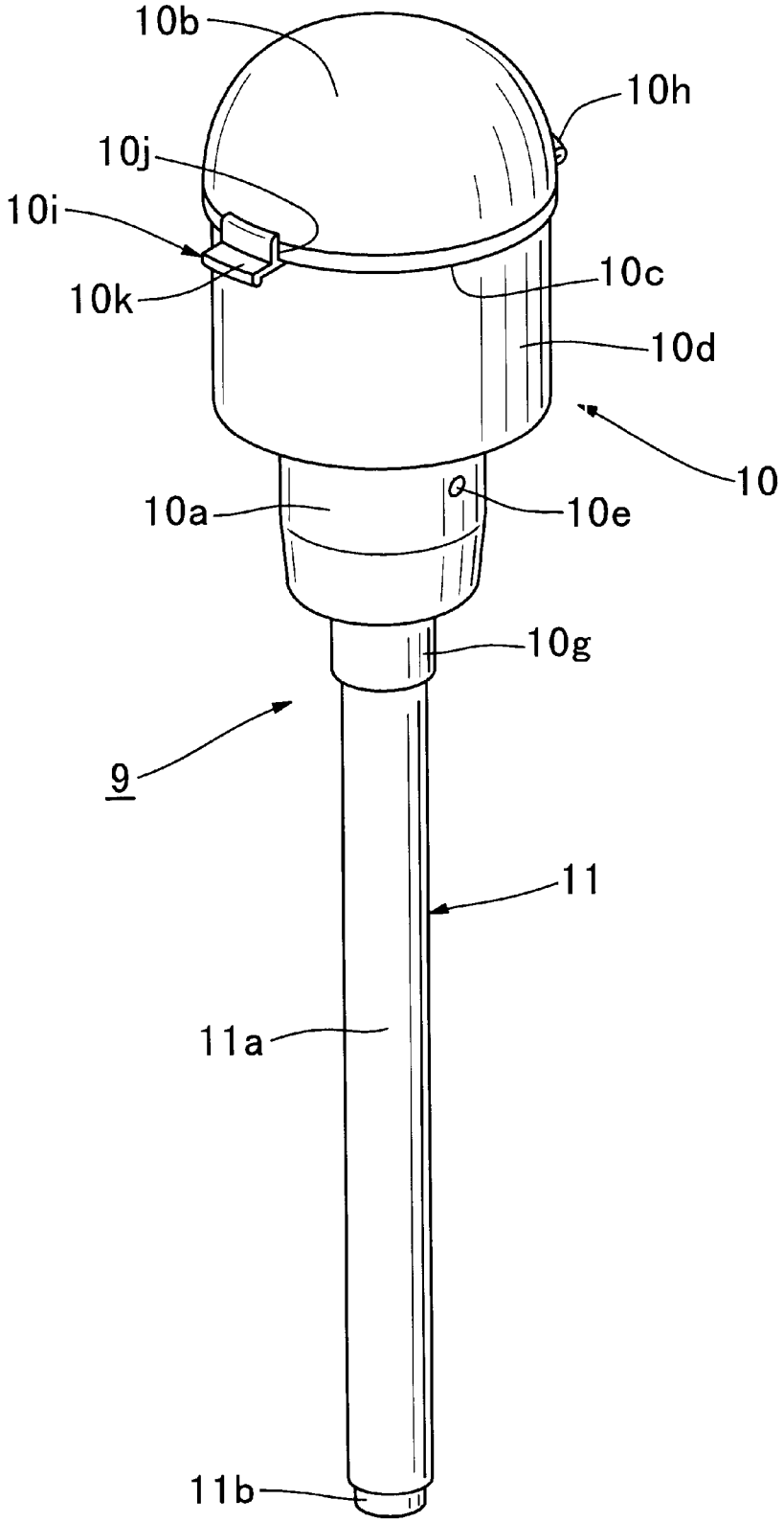
FIG. 11 is a perspective view showing a third embodiment of a straw according to the present invention.
Figure 12:
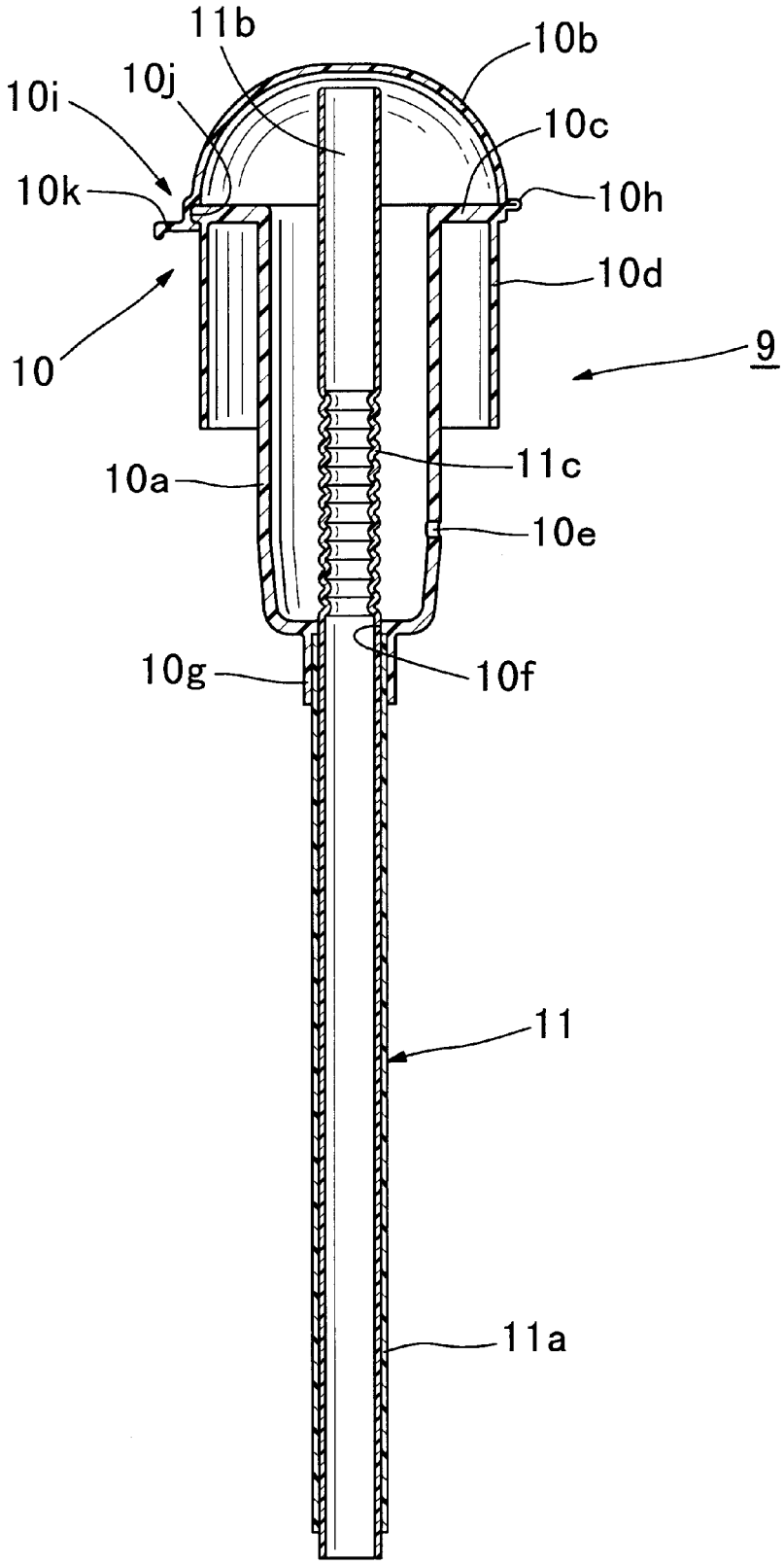
FIG. 12 is a cross-sectional view showing the straw shown in FIG. 11.

A third embodiment of a straw according to the present invention will be described. FIG. 11 is a perspective view showing the third embodiment of the straw according to the present invention, and FIG. 12 is a cross-sectional view showing the straw shown in FIG. 11.

As shown in FIGS. 10 and 11, a straw 9 of the present embodiment is formed of polypropylene, and comprises a plug member 10 and a straw member 11.

The plug member 10 includes a plug portion 10*a* and a cap portion 10*b*. The plug portion 10*a* is formed in a cylindrical shape which includes an opening at a top thereof. A top rim 10*b* is formed on the top of the plug portion 10*a*. A top rim 10*b* surrounds a periphery of the top of the plug portion and protrudes outward therefrom. An outer wall 10*d* is formed on a lower end of the top rim 10*c*. The outer wall 10*d* surrounds a sidewall of the plug portion 10*a* and protrudes downward from the lower end of the top rim 10*c*. The outer wall 10*d* is also spaced apart from the sidewall of the plug portion 10*a* and positioned on the inner side of a side end of the top rim 10*c*. An air vent 10*e* is provided in a lower section of the sidewall of the plug portion 10*a*. At the center of a bottom portion of the plug portion 10*a*, there is provided an aperture 10*f* and an inserting mouth 10*g* which surrounds a periphery of the aperture 10*f* and protrudes downward.

The cap portion 10*b* is formed in a hollow hemispherical shape which has an opening at a lower end thereof. Since an outside diameter of the lower end of the cap portion 10*b* is substantially equal to an outside diameter of the top rim 10*c* of the plug portion 10*a*, the cap portion 10*b* may function as a cap which covers the opening at the top of the plug portion

10*a*. The cap portion 10*b* and the plug portion 10*a* are partially connected with each other by a bendable connecting 10*h*. The connecting member 10*h* is bended when the cap portion is closed, while the connecting member 10*h* is released from the bended state. That is, the cap portion 10*b* is substantially openably/closably mounted on the top of the plug portion 10*a*.

In addition, the cap portion 10*b* is releasably secured to the plug portion by a fitting claw 10*i* which is provided the lower end of the periphery of the cap portion 10*b* and which protrudes downward. The fitting claw 10*i* also includes a U shaped recess 10*j* which is opened inward. Thus, when the cap portion is closed and is loaded with a light force to the fitting claw 10*i* from above, the side end of the top rim 10*c* of the plug portion 10*a* may be interfitted with the U shaped recess 10*j* to secure the cap portion 10*b* to the plug portion 10*a*. Since a tab portion 10*k* is formed on a lower wall of the U shaped recess and protrudes outward, the interfitted state between the U shaped recess 10*j* and the top rim 10*c* or the secured state between the cap portion 10*b* and the plug portion 10*a* may be released by pulling up the tab portion 10*k*.

The straw member 11 includes an outer straw-portion 11*a* and an inner straw portion 11*b* which has a bendable bending portion 11*c* at an upper section thereof. A top of the outer straw portion 11*a* is inserted into and fitted with an inserting mouth 10*g* of the plug portion 10*a*. Since an outside diameter on the outer straw portion 11*a* is substantially equal to an inside diameter of the inserting mouth 10*g*, the outer straw portion 11*a* is secured to the plug member 10 at the top thereof. The inner straw portion 11*b* extends vertically through the aperture 10*f*. A top of the inner straw portion 11*b* reaches the vicinity of a top of the cap portion 10*b* which covers the plug portion 10*a* or is closed, and a lower end of the inner straw portion 11*b* is inserted into and fitted with the outer straw portion 11*a*. Since an inside diameter of the outer straw portion 11*a* is substantially equal to an outside diameter of the inner straw portion 11*b*, the inner straw portion 11*b* slidably touches internally to the outer straw portion 11*a* so that the outer straw portion 11*a* and the inner straw portion 11*b* may function as an integrated straw capable of telescopingly extending and retracting. Since the outside diameter of the inner straw portion 11*b* is substantially equal to a diameter of the aperture 10*f*, no clearance exists between a periphery of the inner straw portion 11*b* and the aperture 11*f*.

Figure 13:
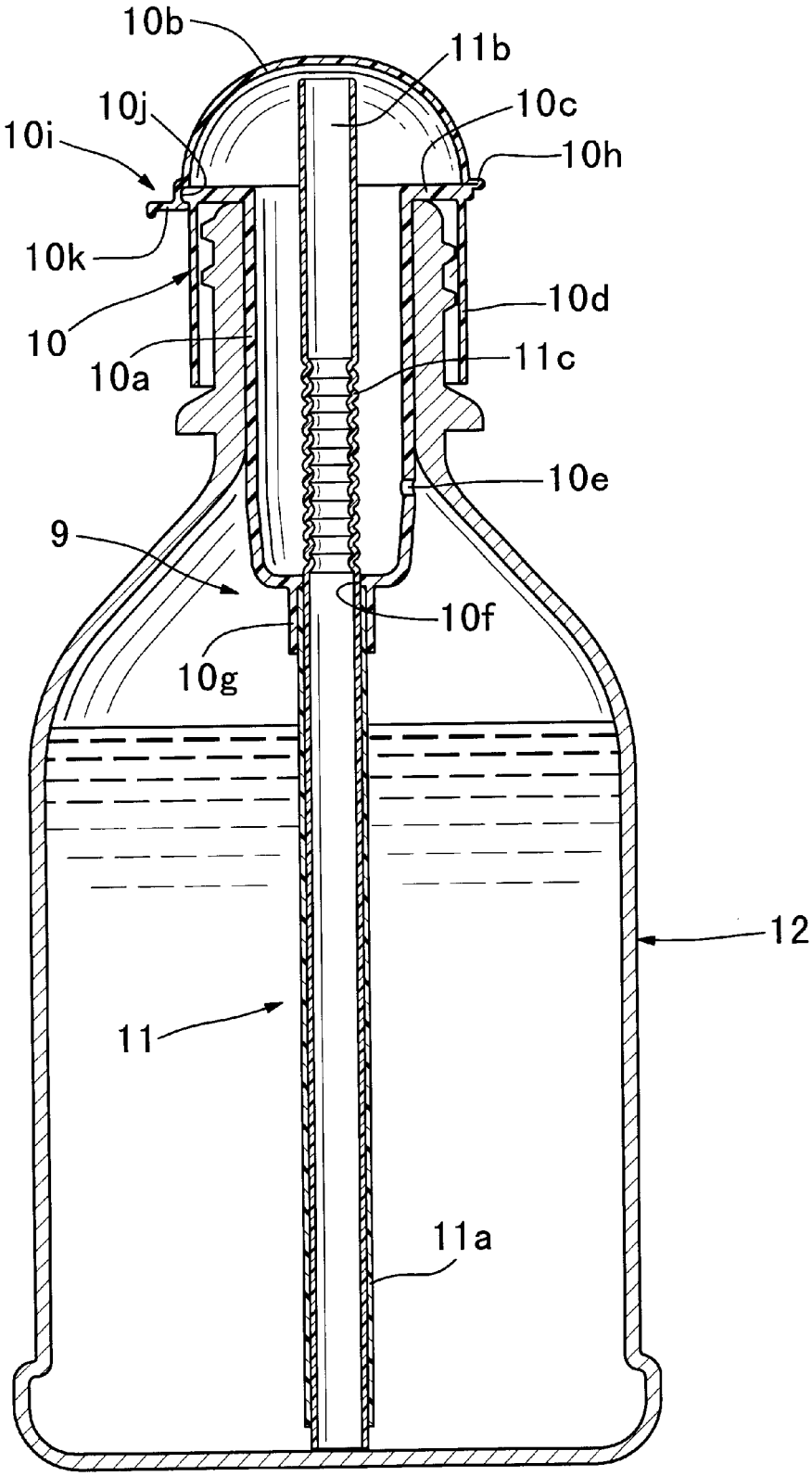
FIG. 13 is a cross-sectional view showing a state where the straw shown in FIG. 11 is inserted into a beverage container.
Figure 14:
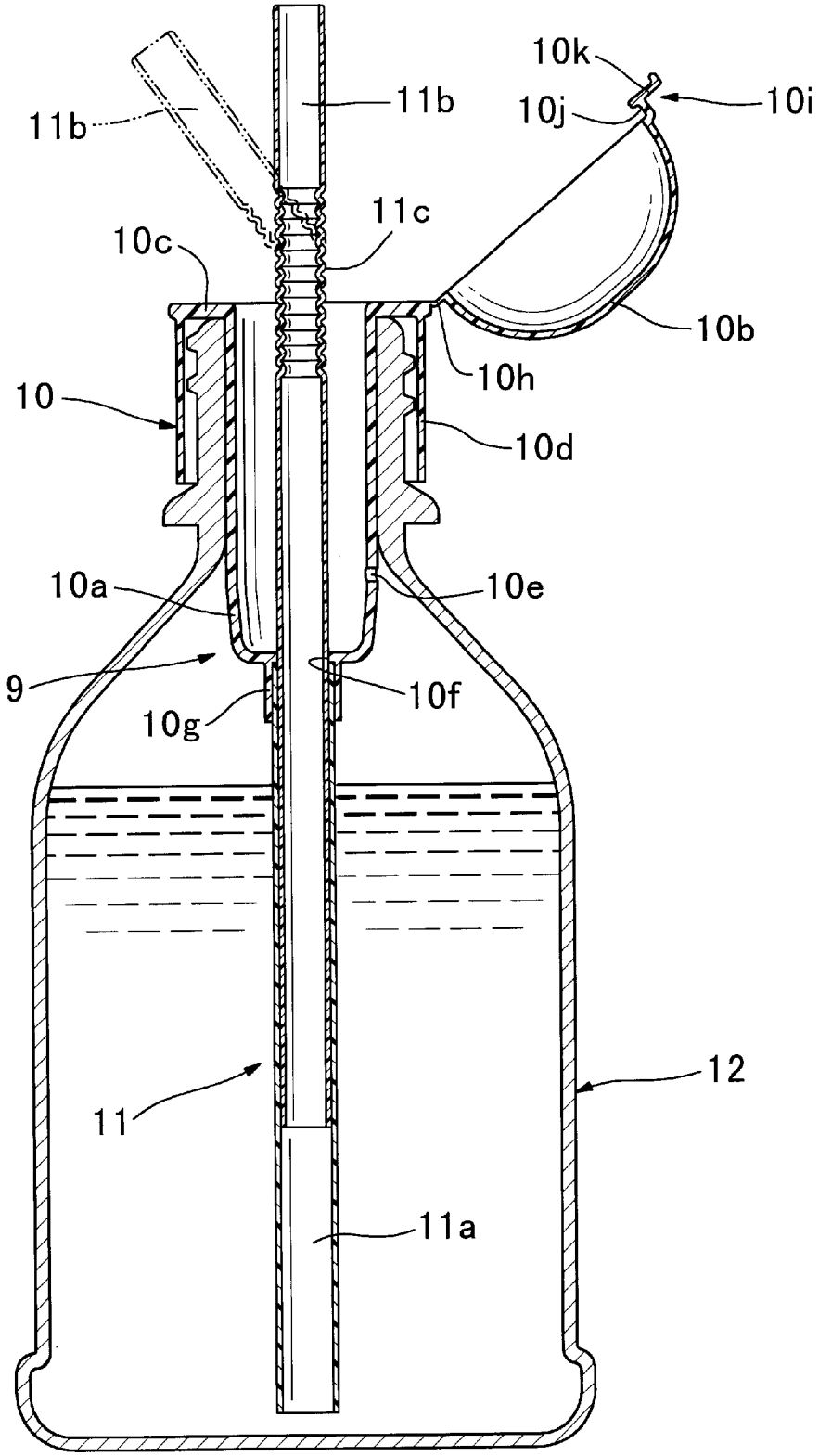
FIG. 14 is a cross-sectional view showing a state where the straw shown in FIG. 11 is used.

FIG. 13 is a cross-sectional view showing a state where the straw shown in FIG. 11 is inserted into the beverage container, and FIG. 14 is a cross-sectional view showing a state where the straw shown in FIG. 11 is used.

As shown in FIGS. 13 and 14, an outside diameter of the sidewall of the plug portion 10*a* is substantially equal to an inside diameter of a mouth of a beverage container 12, and an inside diameter of the outer wall of the plug portion 10*a* is substantially equal to an outside diameter of the mouth of the beverage container 12. Thus, the straw 9 is retained in the inserted state to the beverage container 12 by supporting the top rim 10*c* with the top of the mouth of the beverage container 12 which is sandwiched between the sidewall of the plug portion 10*a* and the outer wall 10*d*. In this state, a lower end of the outer straw portion 11*a* reaches the vicinity of a bottom wall of the beverage container 12. As shown in FIG. 13, when the inner straw portion 11*b* is accommodated in the plug member 10 in which the cap portion 10*b* is closed, the top of the inner straw portion 11*b* protrudes from the mouth of the beverage container 12 and the top rim 10*c* of the plug portion 10*a*.

When a beverage in the beverage container 8 is to be drunk with the straw 9, the tab portion 10*k* is pulled upward to release the interfitted state between the U shaped recess 10*j* and the top rim 10*c* so that the cap portion may be opened. Hereat, since the top of the inner straw portion 11*b* has already protruded from the mouth of the beverage container 12 and the top rim 10*c* of the plug portion 10*a*, the beverage may be readily drunk through the top of the inner straw portion 6*a*. Otherwise, the inner straw portion 11*b* may be further extended or pulled out to make the length of the inner straw portion 11*b* convenient for drinking. Since the top of the inner straw portion has already protruded from the mouth of the beverage container 12 and the upper rim 10*c* of the plug portion 10*a*, it is easy to pull out the inner straw portion 11*b*.

When the straw 9 is to be stored, the cap portion 10*b* is closed as retracting or pushing the inner straw portion 11*b* into the plug member 10 so as to accommodate the top of the inner straw portion 11*b* within the plug member 10, and the cap portion 10*b* is secured to the plug portion 10*a* by giving a light force to the fitting claw 10*i* from above.

Thus, when the straw 9 is stored within the beverage container 12, by virtue of the plug member 10, the straw member 11 is retained so as not to tile and submerge in the beverage, and the upper section of the straw member 11 is protected so as not to be wetted with the beverage. In addition, the air vent 10*e* is provided in the sidewall of the plug member 10. This may prevent the straw 12 from dropping off from the beverage container 12 due to increased inner pressure of the beverage container 12. In addition, since the straw 9 itself has the cap 10*b*, it is unnecessary to store a cap for the beverage container 12 separately from the beverage container.

While the outer straw portion 11*a* and the plug member 10 are separate components in the present embodiment, they may be integrally formed.

Further, while the present embodiment is configured to allow the outer straw portion 11*a* and the inner straw portion 11*b* to slidably touch internally each other, the present invention is not limited to this structure. For example, in the present embodiment, the inside diameter of the outer straw portion 11*a* is set in larger size than the outside diameter of the inner straw portion 11*b* so that the outer straw portion 11*a*, inner straw portion 11*b* and a bottom portion of the plug member adjacent to the aperture 10*f* may function as an integrated straw capable of telescopingly extending and retracting.

Thus, the straw of the present invention is adapted to allow the cap of the beverage container or the straw to be attached in the state where the cap member is emplaced on the top of the mouth of the beverage container. In addition, by virtue of the plug member, the straw member is retained so as not to tile and submerge in the beverage, and the upper section of the straw member is protected so as not to be wetted with the beverage. This enables the straw to be contained and stored within the beverage container, sanitarily and readily, without the inability of taking out the straw from the beverage container or the contamination of hands or surroundings.

In addition, since the air vent is provided in the sidewall of the plug member, the straw may be prevented from dropping off from the beverage container due to increased inner pressure of the beverage container.

Further, since the straw itself has a cap, it may be unnecessary to store a cap for the beverage container separately from the beverage container.

Further, since the inner straw portion is contained within the plug member in which the cap portion is closed, in the state where the top of the inner straw portion protrudes from the mouth of the beverage container and the upper rim of the plug portion, a user may drink just after opening the cap, and it is easy to pull out the inner straw portion.

What is claimed is:

1. A beverage bottle assembly comprising:

a beverage bottle including a body having a bottom and a neck, said neck having an open top end, a cap being provided and adapted to be fitted to said top end of said neck to close the bottle;

a hollow cylindrical plug member having an open top, a substantially cylindrical side wall portion and a bottom, said side wall being fitted to an inside of said neck of the bottle in a manner that said cap of the bottle is allowed to be fitted to said top of the neck after the plug member is fitted to the inside of the neck of the bottle, and said plug member including a top rim, the top rim being located at the open top end of the neck of the bottle so that the top rim is positioned between the open top end and the cap when the cap is mounted on the top end to close the bottle; and a single piece straw extending through said bottom of said plug member, said straw having a lower end positioned in a vicinity of said bottom of said body, said straw having a top end and a portion of said straw extending upwardly from said bottom of said plug member, said portion of said straw being axially collapsible so that said portion of said straw can be housed totally within said plug member by having said portion of said straw axially collapsed to allow said cap to be fitted to said neck of the body.

2. A beverage bottle assembly as claimed in claim 1, wherein said portion of said straw is an accordion flexible portion.

3. A beverage bottle assembly as claimed in claim 1, wherein said top rim projects radially outward beyond said substantially cylindrical side wall portion.

4. A beverage bottle assembly as claimed in claim 1, wherein the bottom of said plug member is flat.

* * * * *